United States Patent [19]

Akizawa

[11] 4,184,775

[45] Jan. 22, 1980

[54] APPARATUS FOR WASHING CEREALS

[76] Inventor: Nobuo Akizawa, 1-5-18, Koenji Minami Sugina-mi-ku, Tokyo, Japan

[21] Appl. No.: 839,669

[22] Filed: Oct. 5, 1977

[51] Int. Cl.[2] ..... B01F 7/16

[52] U.S. Cl. ..... 366/169; 366/250; 99/485

[58] Field of Search ..... 366/169, 245, 247, 250, 366/280; 68/188 R, 181 R; 99/485, 516

[56] References Cited

U.S. PATENT DOCUMENTS

| | | | |
|---|---|---|---|
| 489,028 | 1/1893 | McKinley | 366/280 |
| 3,856,271 | 12/1974 | Lodige | 366/169 |

*Primary Examiner*—Robert W. Jenkins

*Attorney, Agent, or Firm*—Oldham, Oldham, Hudak & Weber Co.

[57] ABSTRACT

An apparatus for washing cerals with a rotar powered by a jet water by collecting a certain amount of cereals in the container.

6 Claims, 5 Drawing Figures

Fig . 3
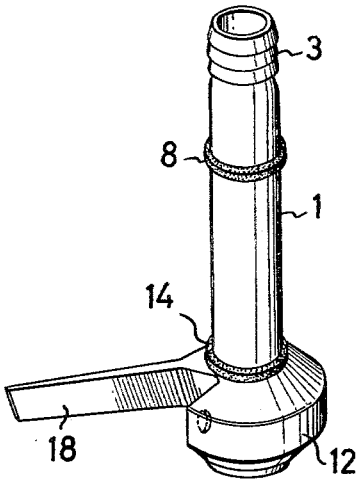
Fig . 4
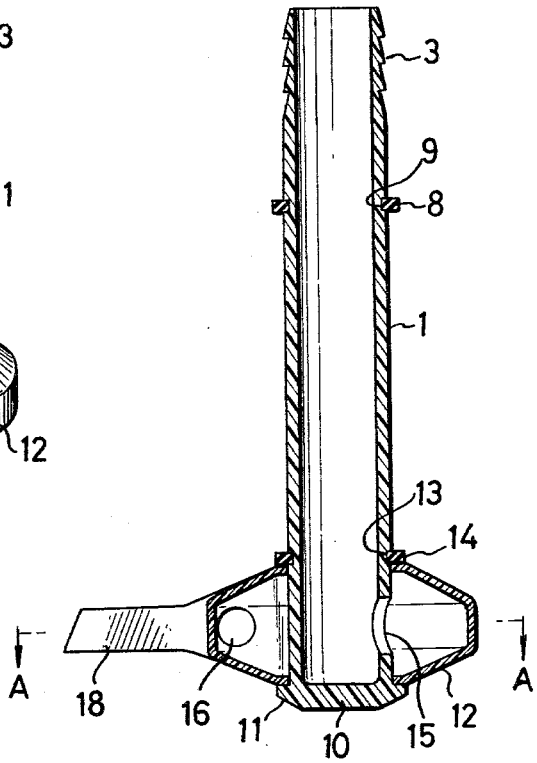
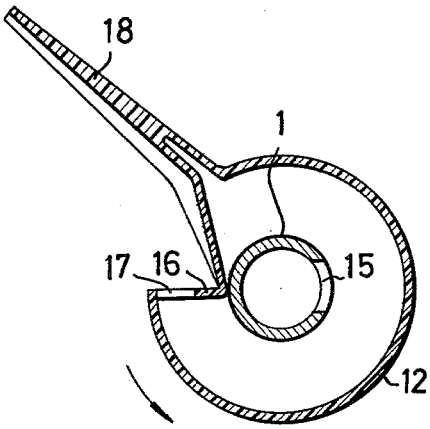
Fig . 5

APPARATUS FOR WASHING CEREALS

SUMMARY OF THE INVENTION

This invention relates to an apparatus for washing cereals.

An object of this invention is to provide an apparatus for washing cereals by the pressurised water, such as one of the water supply source, without use of other power means in washing cereals.

Another object of this invention is to provide an apparatus for washing cereals by collecting a certain amount of cereals in the container with repeating an action of agitating the cereals within the container described above by a part of them.

And further object of this invention is to obtain an apparatus for washing cereals adapted to enable it to wash cereals in turn with use of a clean water which is drained as a washing drainage from the screening member of the container, and is to get the energy for washing them from a pressurized water such as one of the water supply source, as well as to use the water as a washing water.

This applicant has already made a patent application in America, U.S. Pat. No. 3,938,534, entitled "Method of and Apparatus for washing cereals" apparatus washable a large amount of cereals, but in this (old) invention an enough washing of cereals is difficult to make for shortness in time for washing them stayed in the container. While in this invention (new) and enough washing can be made for cereals collected in the container to the extent desired.

BRIEF DESCRIPTION OF THE SEVERAL VIEWS OF DRAWINGS

This invention will be better understood from the following description taken, in connection with the accompanying drawings, in which:

FIG. 3 is the schematic oblique view of that as shown in FIG. 1;

FIG. 4 is an enlarging side view vertically cut taking along the central line of FIG. 3; and FIG. 5 is the plan view laterally cut taking along the line A—A as shown in FIG. 4.

DETAILED DESCRIPTION OF THIS INVENTION

Figure 1:
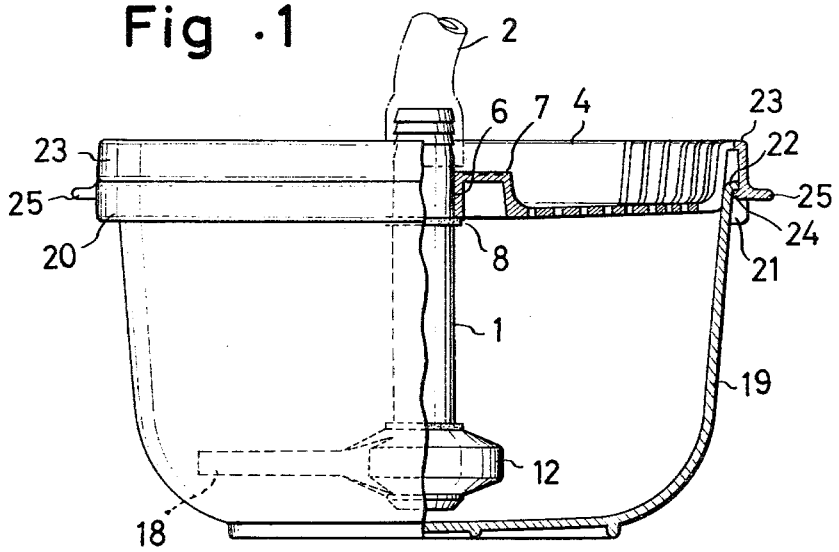
FIG. 1 is the side view partly cut off and shown in vertical section of the illustrative embodiment of this invention.
Figure 2:
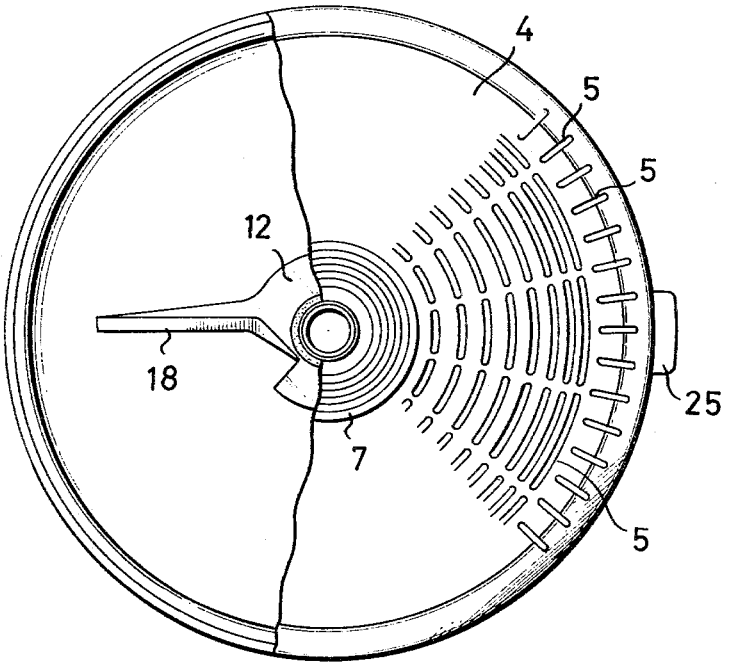
FIG. 2 is the plan view partly cut off of that as shown in FIG. 1.

This invention relates to an apparatus for washing cereals collected in the container through the force of a pressurized water such as one of the water supply source. There is illustrated a description of the embodiment example of this invention.

Numeral 1 indicates a water supply tube, to the upper and of which a hose 2 is connected at one end thereof so as to fit whereon, and the other end thereof is connected to the faucet of the water supply source. Recesses to secure 3, 3, 3 are equipped to the upper side wall of the water supply tube 1 so as to prevent the hose 2 from dropping off from the sluices. As a mean to connect the hose 2 to the water supply tube 1, a suitable mean can be selected from means such as one to rotatingly secure the hose 2 to the tube 1 by providing projections on one of them (the hose 2 and the tube 1) and fitting recess formed on the other of them to the projections and one to engage screw threads formed on one of them with those on the other by forming screw threads on each of them.

Numeral 4 indicates a screening member having therethrough a great many openings 5,5 bored allowing to pass through water, dust and the like except cereals, beans and the like to be washed. The said openings 5,5 may be formed in any shape such as slits or holes.

The screening member 4 is equipped with a hole 6 at the center thereof to allow the water supply tube 1 to fit into it. The said hole 6 is bored on a rib 7 which is made for reinforcing the strength of the screening member 4 and for making easily handle it on designing, but which may not be provided.

Numeral 8 indicates a ring fitted onto a recess 9 provided on the water supply tube 1 with a purpose of controlling the position of the screening member 4 when inserted into the water supply tube 1.

The water supply tube 1 is closed with a floor plate 10 at the lower end thereof, where a projecting part 11 is provided.

Numeral 12 indicates a rotor freely rotatably mounted on the water supply tube 1, with the lower and the upper end of it being controlled respectively by the projection 11 and the ring 14 fitted onto a recess 13 provided to the water supply tube 1. The said rotor 12 is constructed so as to rotate around a hollow hole 15 bored into the water supply tube 1, and be centered on the tube 1, with a jet hole 17 provided in a wall 16 formed in the rotor and extending in a radial direction to the rotor so as for the wall being nearly perpendicular to it.

Numeral 18 indicates a rotation control arm projected from the rotor 12. With said rotor control arm 18, the most efficient way of controlling it is to provide it so as for it to face the jet hole 17. And the plate or arm 18 facing the jet hole 17 is better to make it upper and outwardly slant. The rotation control may be done with a reverse jet by providing another jet hole at a position symmetrical to the jet hole 17 or other position without use of the rotation control arm 18.

Water runs out along the control arm 18 and flushes cereal positioned thereat away from the leading edge of the control arm 18. Then the rotor and arm are released to be driven forwardly as indicated in FIG. 5.

Numeral 19 indicates a container having a projection 20 formed on the outside of its upper periphery, with a stretched strip 21, having elasticity, provided to the screening member 4 at the outside thereof formed so as for it to engage with the projection 20 when fitting the screening member to the container 19.

Numeral 25 indicates a handle stretched outward in the opposite direction to the stretched strip 24 at the same position thereto. As for the construction of engaging the screening member 4 with the container 19, a suitable mean can be selected from ones to pressingly fit more easily the screening member 4 into the container 19 and to engage one with the other by providing a short screw thread on each of them.

Now, an explanation for the use and the actions of the apparatus is to be made, and cereals such as, for example, rice, barley, beans and the like to be washed are put into the container 19 which is flatly laid on a place of a good drainage such as sink and the like, with the container 19 fitted to the screen member 4. The fitting as described above can be made by pressing the stretched strip 24 from above to engage it with the projection 22 provided to the container 19 while making the stretched strips 23, 23 of the screening member 4 be positioned so as for the cut off part 21 of the drooping part 20 to attach to it. And the water supply tube 1 having the rotor 12 fitted thereto at the lower part thereof is inserted through the hole 6 of the screening member 4 and, moreover, the lower end of the water supply tube 1 is made to be positioned so as for it to contact or be spaced a little from the floor part of the container 19. This screening member 4 and the water supply tube 1 may be unitedly and fixedly formed.

The water supply tube 1 is connected to the hose 2 connected to the faucet of the water supply source at its upper end.

When feeding water from the water supply source, water passing through the hose 2 and the water supply tube 1 flows into the rotor 12 and through the hole 15 provided to the water supply tube 1 at the lower end thereof to be jetted from the jet hole 17. And by the reaction of the jet power described above, the rotor 12 is made to rotate in the direction of an arrow line as shown in FIG. 5.

The jet stream of water from the jet hole 17 blows away cereals and the like deposited near the floor of the container 19 to strike them to the inner wall of the container 19, with a part of the cereals making an eddy stream by colliding against the screening member 4 positioned at the upper part of the container 19 and then by dropping, simultaneously when the friction among cereals was done. By this action a part of cereals within the container 19 are washed. And with the progressive and continuous rotation of the rotor 12 cereals are washed by a part of them, and the whole quantities of cereals can be washed once by one rotation of the rotor 12, thus resulting in enabling to completely wash cereals by the repetition of this action.

The rotating speed of the rotor 12 is controlled by the stretching out of the rotation control arm 18, the rotor 12 is made to rotate slowly, therefore the jet power can be applied enough to cereals. A plate 18' of the rotation control arm 18 facing the rotor 12 being slanted upward, cereals running against the plate 18 are made to be pushed upward, therefore causing the shock against cereals small.

The rotation speed of the rotor 12 can be arbitrarily selected by determining suitably the quantities of water and cutting the rotation control arm 18 to a suitable length. The resulting drainage is overflown from the openings 5,5 of the screening member 4.

After the completion of washing, the screening member 4 is taken off from the container 19 by disengaging the stretched strips 24, 24 with the projections 22, 22 after stopping of the feeding of water and pressing down the handles 25, 25.

According to the invention described above, the washing of cereals can be made automatically in short time by a very effective washing. And, moreover, cereals can be washed without cracking of them for the washing with use of the jet and eddy stream.

What is claimed is:

1. An apparatus for washing cereals and the like comprising in combination a container, a hollow water supply tube having a rotor freely rotatably fitted to it and enclosing a hole formed at its lower part, the said rotor being provided with a rotation control part and a jet hole formed in a wall section of said rotor that extends radially of such rotor to give a reaction in the direction of its rotation, the water supply tube being adapted to have a pressurized water supply tube freely separably connected to it at its upper end, and a screening member which is freely fitted onto a off from the upper part of the container, and which has a plurality of openin therein, said supply tube passing through the screening member at a center area thereof.

2. An apparatus for washing cereals and the like as set forth in claim 1 wherein the rotation control part of the rotor is a small hole made at the position symmetrical to the jet hole.

3. An apparatus for washing cereals and the like as set forth in claim 1 wherein the rotation control part of the rotor is a control arm that terminates radially spaced from said container, and said control arm includes a front face that slants rearwardly from its lower edge to its upper edge.

4. An apparatus for washing cereals and the like as set forth in claim 3 wherein said rotor, said jet hole and wall section and said rotation control arm lie in a common plane.

5. An apparatus for washing cereals and the like as set forth in claim 1 wherein the rotation control part of the rotor includes a rotation control arm extending substantially radially of said container, said control arm having an outer section with a planar front face that is inclined backwardly slightly from its lower edge to its upper edge.

6. An apparatus for washing cereals and the like as set forth in claim 5 where said jet hole expels water for flow along said control arm and upwardly of said container to cause cereal in said container to flow up away from said control arm and facilitate rotation thereof.

* * * * *